US011519261B2

(12) United States Patent
Vick, Jr. et al.

(10) Patent No.: US 11,519,261 B2
(45) Date of Patent: Dec. 6, 2022

(54) DEPLOYMENT OF DOWNHOLE SENSORS

(71) Applicant: HALLIBURTON ENERGY SERVICES, INC., Houston, TX (US)

(72) Inventors: James Dan Vick, Jr., Dallas, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 582 days.

(21) Appl. No.: 16/340,102

(22) PCT Filed: Apr. 10, 2018

(86) PCT No.: PCT/US2018/026871

§ 371 (c)(1),
(2) Date: Apr. 6, 2019

(87) PCT Pub. No.: WO2019/199275

PCT Pub. Date: Oct. 17, 2019

(65) Prior Publication Data

US 2021/0332693 A1 Oct. 28, 2021

(51) Int. Cl.

| | |
|---|---|
| ***E21B 47/01*** | (2012.01) |
| ***E21B 47/13*** | (2012.01) |
| ***E21B 23/00*** | (2006.01) |
| ***E21B 47/11*** | (2012.01) |

(52) U.S. Cl.

CPC ..... *E21B 47/01* (2013.01); *E21B 23/00* (2013.01); *E21B 47/11* (2020.05); *E21B 47/13* (2020.05)

(58) Field of Classification Search

CPC ..... E21B 47/01; E21B 47/11; E21B 47/13; E21B 23/00; E21B 23/0411

See application file for complete search history.

(56) References Cited

U.S. PATENT DOCUMENTS

| | | | | |
|---|---|---|---|---|
| 6,467,387 | B1 | 10/2002 | Espinosa et al. | |
| 7,140,434 | B2 | 11/2006 | Chouzenoux et al. | |
| 8,056,623 | B2 | 11/2011 | Schmitt et al. | |
| 8,141,631 | B2 | 3/2012 | Chouzenoux et al. | |
| 2002/0046840 | A1 * | 4/2002 | Schetky ..... | E21B 43/108 166/227 |

(Continued)

FOREIGN PATENT DOCUMENTS

| | | | |
|---|---|---|---|
| EP | 1455052 | A2 | 9/2004 |
| WO | 2016076853 | A1 | 5/2016 |

OTHER PUBLICATIONS

International Search Report and Written Opinion for PCT application No. PCT/US2018/026871 dated Jan. 8, 2019, 22 pages.

*Primary Examiner* — Caroline N Butcher
(74) *Attorney, Agent, or Firm* — Kilpatrick Townsend & Stockton LLP

(57) ABSTRACT

A sensor assembly includes a patch with a wall configured to be seated in a well casing. A sensor is mounted to the wall of the patch. The wall of the patch can define a central passage therethrough configured to allow passage of downhole tools therethrough. The wall of the patch can be expandable from a first compressed diameter to a second expanded diameter. The wall of the patch can include at least one of a corrugated expandable structure, a stretchable structure, and/or an internally trussed expandable structure, for example.

15 Claims, 7 Drawing Sheets

(56) References Cited

U.S. PATENT DOCUMENTS

| | | | | |
|---|---|---|---|---|
| 2003/0056952 | A1* | 3/2003 | Stegemeier | E21B 47/11 166/250.12 |
| 2003/0058127 | A1 | 3/2003 | Babour et al. | |
| 2009/0188569 | A1* | 7/2009 | Saltel | E21B 47/01 137/15.11 |
| 2009/0211770 | A1 | 8/2009 | Nutley et al. | |
| 2016/0258284 | A1* | 9/2016 | Bittar | E21B 47/125 |
| 2016/0312567 | A1 | 10/2016 | Murphree et al. | |
| 2018/0266236 | A1* | 9/2018 | Scogin | E21B 47/01 |

* cited by examiner

DEPLOYMENT OF DOWNHOLE SENSORS

BACKGROUND OF THE INVENTION

1. Field of the Invention

The present disclosure relates to downhole sensors and telemetry, and more particularly to deployment of downhole sensors.

2. Description of Related Art

Downhole sensors have inherent longevity issues. They also have limited upgrade capability. When a sensor fails, or if there is a new, improved sensor it is not always readily apparent how to deploy the replacement in an existing well.

The conventional techniques have been considered satisfactory for their intended purpose. However, there is an ever present need for improved deployment of downhole sensors. This disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
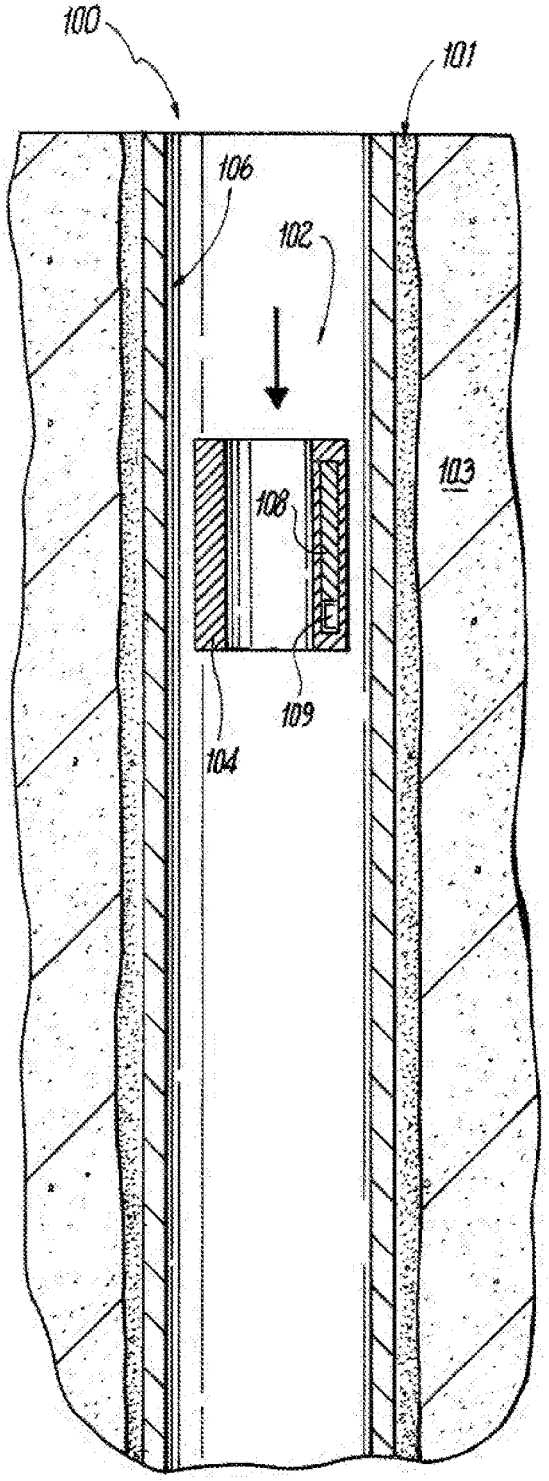
FIG. 1 is a schematic cross-sectional side elevation view of an exemplary embodiment of a sensor assembly constructed in accordance with the present disclosure, showing a patch with a sensor being deployed in an unexpanded state in a well casing.

Reference will now be made to the drawings wherein like reference numerals identify similar structural features or aspects of the subject disclosure. For purposes of explanation and illustration, and not limitation, a partial view of an exemplary embodiment of a sensor assembly in accordance with the disclosure is shown in FIG. 1 and is designated generally by reference character 100. Other embodiments of sensor assemblies in accordance with the disclosure, or aspects thereof, are provided in FIGS. 2-17, as will be described. The systems and methods described herein can be used for deployment of downhole sensors, e.g., for initial placement in new well bores or existing well bores, replacement and/or upgrades in existing well bores, and the like.

Figure 2:
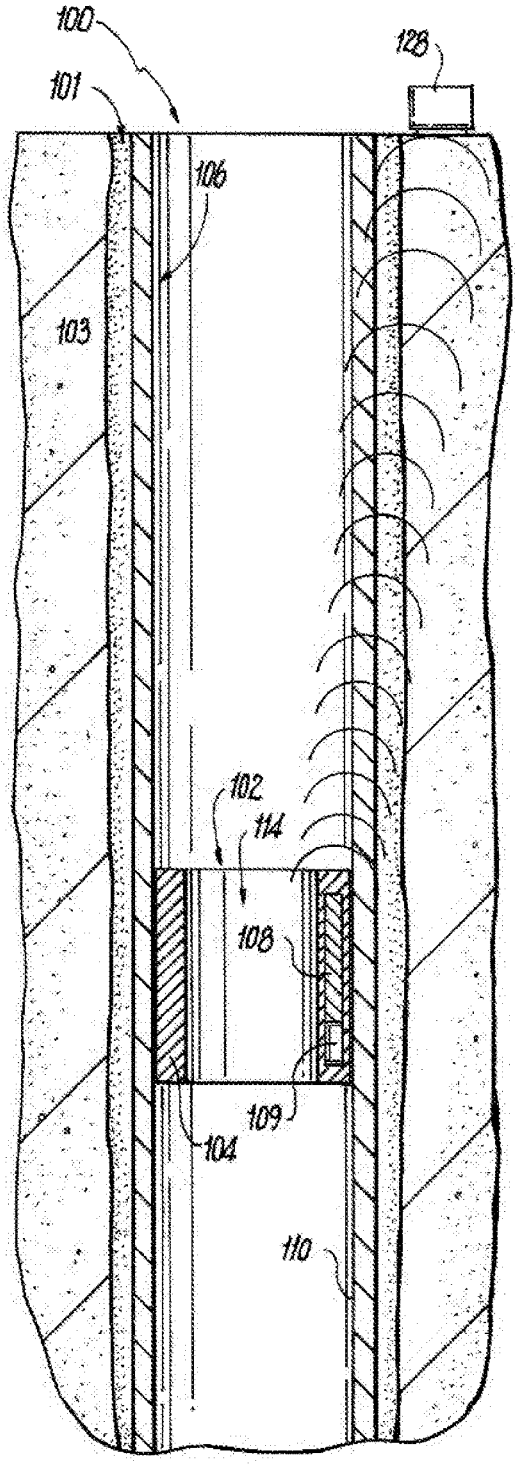
FIG. 2 is a schematic cross-sectional side elevation view of the sensor assembly of FIG. 1, showing the patch in an expanded state seated against the well casing.
Figure 3:
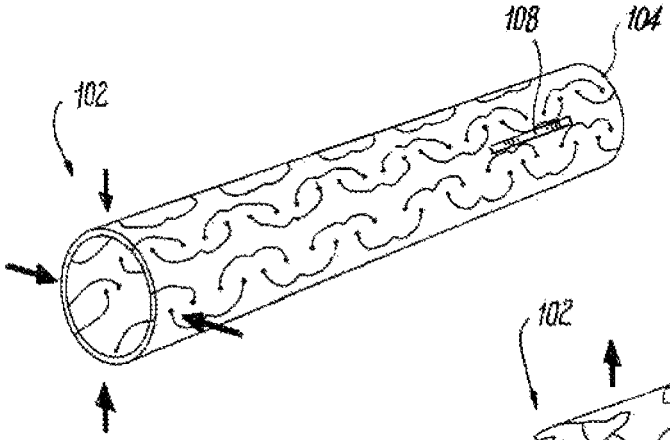
FIG. 3 is a perspective view of the sensor assembly of FIG. 1, showing the patch in an unexpanded state.
Figure 4:
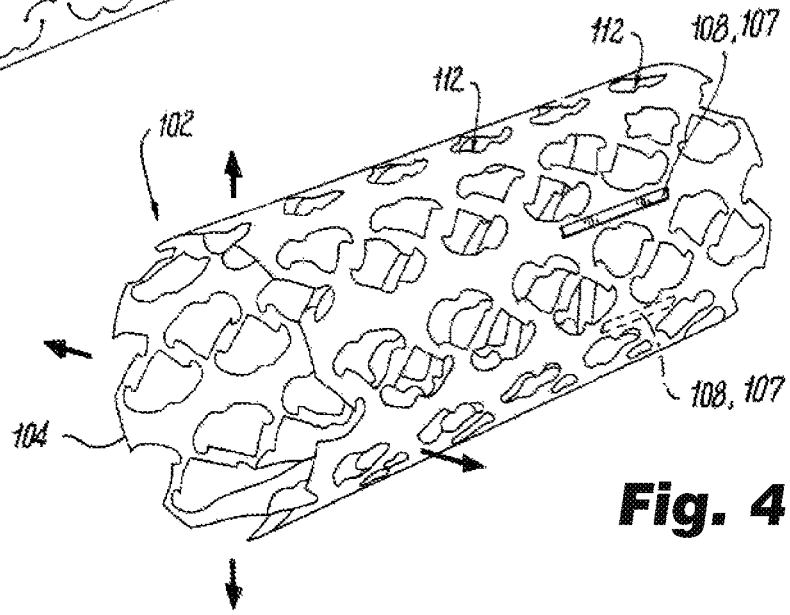
FIG. 4 is a perspective view of the sensor assembly of FIG. 3, showing the patch in an expanded state.
Figure 5:
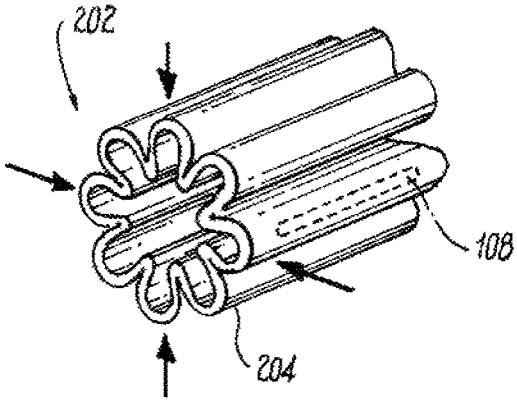
FIG. 5 is a perspective view of another exemplary embedment of a sensor assembly constructed in accordance with the present disclosure, showing a corrugated patch in an unexpanded state.
Figure 6:
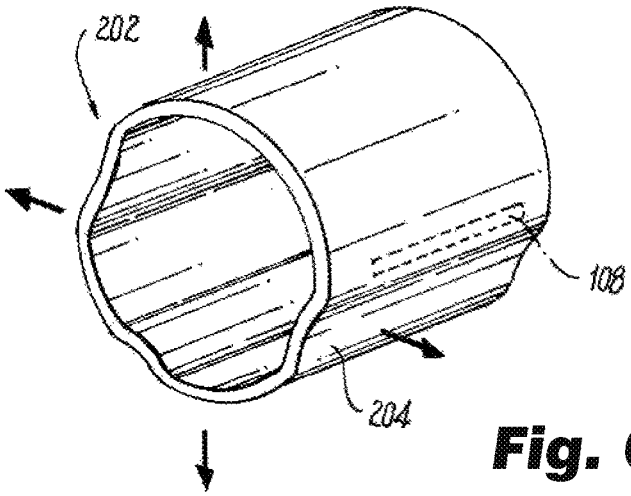
FIG. 6 is a perspective view of the sensor assembly of FIG. 5, showing the patch in an expanded state.
Figure 7:
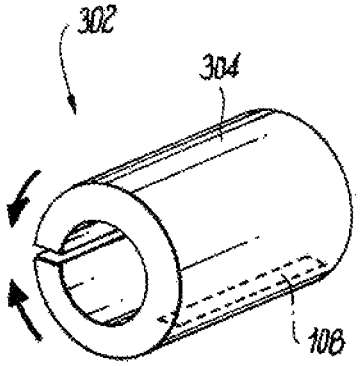
FIG. 7 is a perspective view of another exemplary embedment of a sensor assembly constructed in accordance with the present disclosure, showing a c-ring patch in an unexpanded state.
Figure 8:
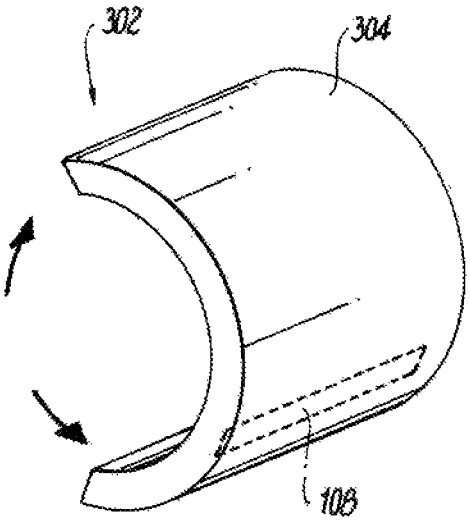
FIG. 8 is a perspective view of the sensor assembly of FIG. 7, showing the patch in an expanded state.
Figure 9:
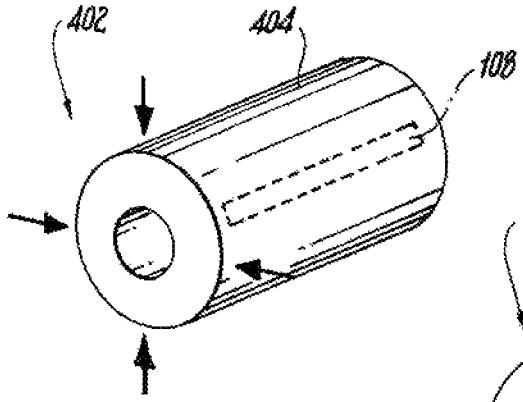
FIG. 9 is a perspective view of another exemplary embedment of a sensor assembly constructed in accordance with the present disclosure, showing a stretchable o-ring patch in an unexpanded state.
Figure 10:
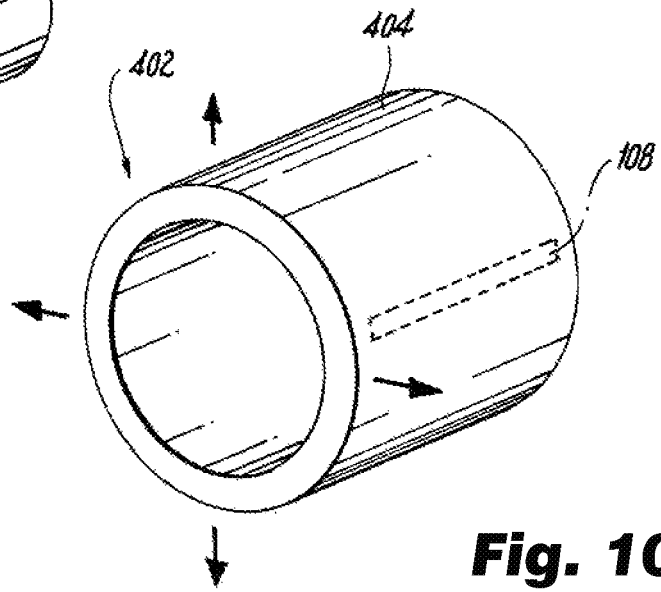
FIG. 10 is a perspective view of the sensor assembly of FIG. 9, showing the patch in an expanded state.
Figure 11:
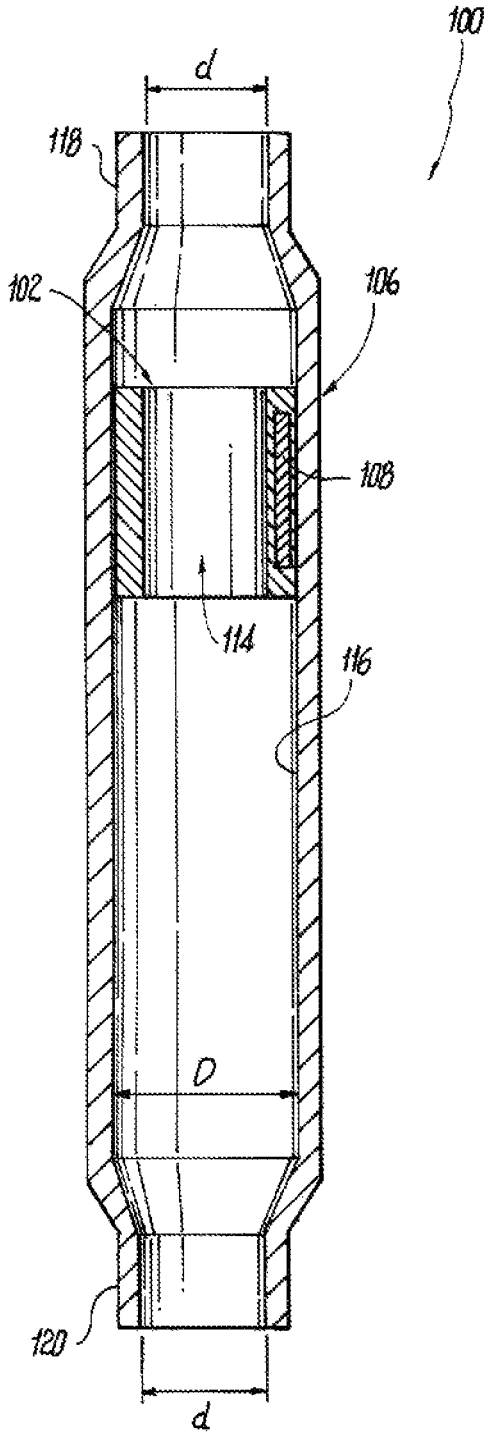
FIG. 11 is a schematic cross-sectional side elevation view of the sensor assembly of FIG. 1, showing the patch seated in an expanded diameter portion of the well casing.

The sensor assembly 100 includes a patch 102 with a wall 104 configured to be seated in a well casing 106. A sensor 108 is mounted to the wall 104 of the patch 102. The wall 104 of the patch 102 is expandable from an unexpanded diameter for traversing through the well casing 106 as shown in FIG. 1, to an expanded diameter, as shown in FIG. 2, for seating against the inner surface 110 of the will casing 106 that is within an annulus 101 of a well in an earth formation 103. With reference to FIGS. 3-4, the wall 104 of the patch 102 includes an internally trussed expandable structure, which is shown in FIG. 3 unexpanded and in FIG. 4 expanded. The expansion can be accomplished by releasing the patch 102 from a compressed state to allow it to expand, by using a tool to mechanically press outward on the wall 104 of the patch 102, or the like. As shown in FIGS. 3-4, the sensor 108 is affixed or mounted to a portion of the wall 104 of the patch 102 that is aligned between the apertures 112, allowing the sensor 108 to remain affixed to the wall 104 regardless of whether the wall 104 is an expanded or unexpanded state. It is also contemplated that the sensor can be placed on the interior of the surface or within the wall of the expanded structure. Those skilled in the art will readily appreciate that any other suitable type of expandable wall 104 can be used without departing from the scope of this disclosure. Other examples of expandable walls include a bendable corrugated expandable wall 204 of patch 202, which includes a sensor 108 mounted thereto as shown in FIGS. 5 and 6 in unexpanded and expanded states, respectively, a bendable c-ring wall 304 of patch 300 with a sensor 108 mounted thereto as shown in FIGS. 7 and 8 in unexpanded and expanded states, respectively, and a wall 404 with a stretchable structure of a patch 400 with a sensor 108 mounted thereto as shown in FIGS. 9 and 10 in unexpanded and expanded states, respectively. It is also contemplated that the sensor 108 can be integral with the patch 102, e.g., with the wall 104 of the patch 102.

Although the wellbore is shown as a cased hole, those skilled in the art will readily appreciate that the sensor assembly 100 can be expanded to fit within production tubing or within an uncased open hole section. In all of these cases, the sensor assembly 100 can be installed on the interior wall of a portion of the wellbore. The axis of the sensor assembly 100 is substantially parallel to the axis of the wellbore.

With reference again to FIG. 2, the wall 104 of the patch 102, when affixed to the inner surface 110 of the well casing 106, defines a central passage 114 therethrough configured to allow passage of downhole tools therethrough. The drift diameter of a well casing is the maximum diameter that at downhole tool can have and still pass through the well casing. In FIG. 2, the diameter of the central passage 114 must be large enough to clear or provide an intended drift diameter, which in turn means that the well casing 106 must have a large enough inner diameter to accommodate the radial thickness of patch 102 and sensor 108 and still allow the central passage 114 to be equal to or larger than the intended drift diameter. As shown in FIG. 3, the well casing 106 can include an expanded diameter portion 116 with an inner diameter D lager than an inner diameter d of portions 118 and 120 of the well casing 106 uphole and downhole from the expanded diameter portion 116. With the patch 102 and sensor 108 seated within the expanded diameter portion 116, the portions 118 and 120 of the well casing 106 can have an inner diameter as small as the intended drift diameter, and the central passage 114 of the patch 102 can still have a diameter equal to or greater than the intended drift diameter without needing the entire well casing 106 to have a larger interior diameter than the intended drift diameter. The expanded diameter portion 116 can allow for a thicker patch 102 and/or sensor 108 while still maintaining a given drift diameter.

The sensor 108 can be a passive sensor, e.g., such as a sensor that includes a tracer configured to release a chemical. It is also contemplated that the sensor 108 can be an active sensor, e.g., such as a sensor that includes an electrically powered transducer for measuring pressure, temperature, flow rate, flow composition, vibration, acoustics, permeability and/or the like. As indicated by the wireless wave lines in FIG. 2, the sensor 108 can be configured to be coupled to electronics and/or wireless telemetry. For example, in FIG. 2, the sensor 108 is wirelessly connected to communicate data to and/or from a surface system 128. The sensor 108 can include an internal power source 109, such as a battery or a turbine generator, however it is also contemplated that the sensor 108 can receive power, e.g., inductively from the well casing 106, as described below.

Figure 12:
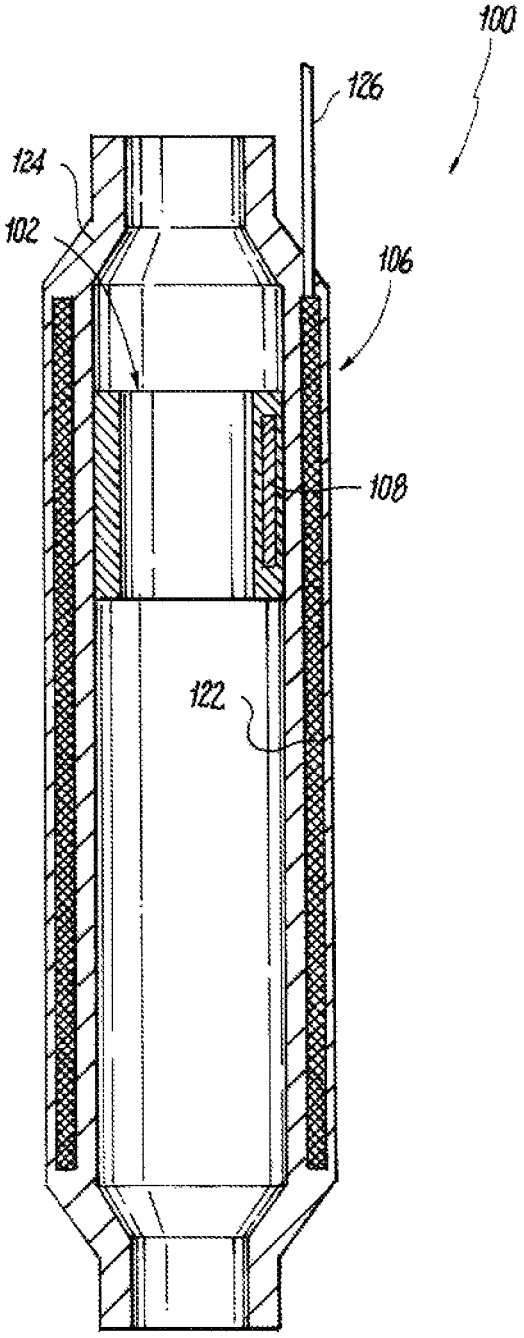
FIG. 12 is a schematic cross-sectional side elevation view of the sensor assembly of FIG. 1, showing the patch seated in the well casing with the sensor operatively connected to a coil within the well casing for power and/or communication.
Figure 13:
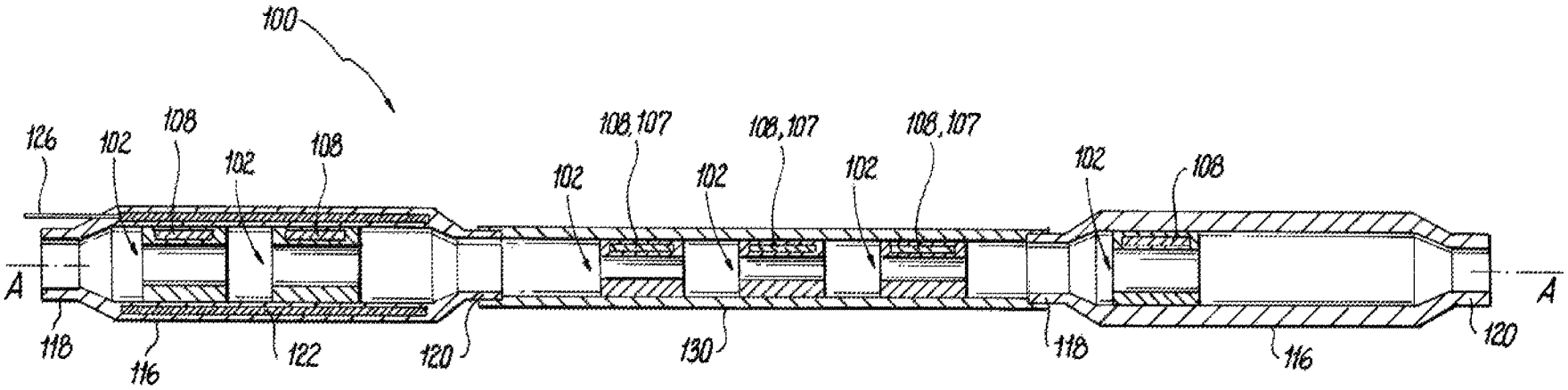
FIG. 13 is a schematic cross-sectional side elevation view of the sensor assembly of FIG. 1, showing the sensor assembly being one of a plurality of sensor assemblies within the well casing.
Figure 14:
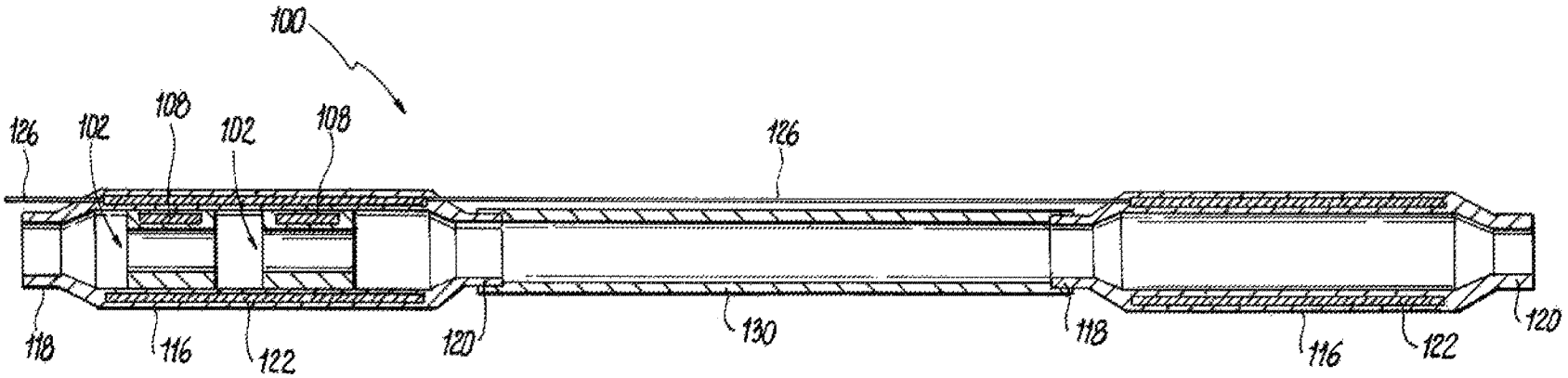
FIG. 14 is a schematic cross-sectional side elevation view of the sensor assembly of FIG. 1, showing the well casing with multiple spaced apart coils connected by a line for power and/or communication.

With reference now to FIG. 12, the well casing 106 can include a coil 122 (or multiple coils 122) wound circumferentially around the wall 124 thereof, wherein the coil 122 is electrically connected to a line 126 for communication and/or power. Line 126 can be an optical line that provides a data connection but not power, or can be an electrical line that provides data and/or power connectivity. The coil 122 is inductively connected to the sensor 108 to power the sensor 108 and/or for data communication between the sensor 108 and systems up well such as the surface system 128 shown in FIG. 1. It is also contemplated that capacitive couplings, wet connects, or any other suitable connection can be made between the sensor 108 and the coil 122. As shown in FIGS. 13 and 14, the well casing can include multiple small diameter portions 118, 120, and 130 and multiple expanded diameter portions 116. In FIG. 13, only the left most expanded diameter portion 116 of the well casing 106 includes a coil 122, and the right most expanded diameter portion 116 does not include a coil. In FIG. 14, both of the expanded diameter portions 116 include a respective coil 122, and the two coils 122 are connected together by a line 126. Each of the expanded diameter portions 116 in FIG. 14 is a powered joint, and those skilled in the art will readily appreciate that any suitable number of such powered joints can be included in a well casing 106. The powered joints can be hard wired with little or no electronics and thus can be made to be long lived.

With continued reference to FIGS. 13 and 14, there can be multiple patches 102 with respective sensors 108 seated within the well casing 106. FIG. 13 shows six patches 102 with respective sensors 108, and FIG. 14 shows two patches with respective sensors 108, however those skilled in the art will readily appreciate that any suitable number of patches 106 and sensors 108 can be used without departing from the scope of this disclosure. The assembly 100 can include at least one distributed sensor 108 having sensor components 107 operatively connected to each other but physically spaced apart from one another. For example, in FIG. 14 the sensor 108 can optionally include two separate sensor components 107 (one of which is shown in broken lines) circumferentially spaced apart from one another physically, but connected together wirelessly or by wiring to function together. For example, one of the sensor components 107 can include power components and processing components, and the other sensor component 107 can include transducer connected by wire or wirelessly to the power and processing components. It is also contemplated that two or more sensor components 107 of a sensor 108 can be separated along a longitudinal axis A of the well casing 106 as shown in FIG. 13 where three sensor components 107 of a single sensor 108 in the portion 130 of the well casing 106 are identified. It is also contemplated that distributed sensor components 107 can be both axially distributed as shown in FIG. 13 and circumferentially distributed as shown in FIG. 4.

FIG. 13 demonstrates multiple configurations that can be used. For example, the two sensors 108 in the left most enlarged diameter portion 116 of FIG. 13 can be larger sized (radially thicker) sensors/transmitters/receivers powered by the coil 122, the three sensors 108 in the smaller diameter portion 130 can be passive or battery powered sensors of a smaller size (radially thinner) than those in the expanded diameter portions 116, and the sensor 108 in the right most expanded diameter portion 116 can be a large sized (radially thicker) passive or battery powered sensor.

Figure 15:
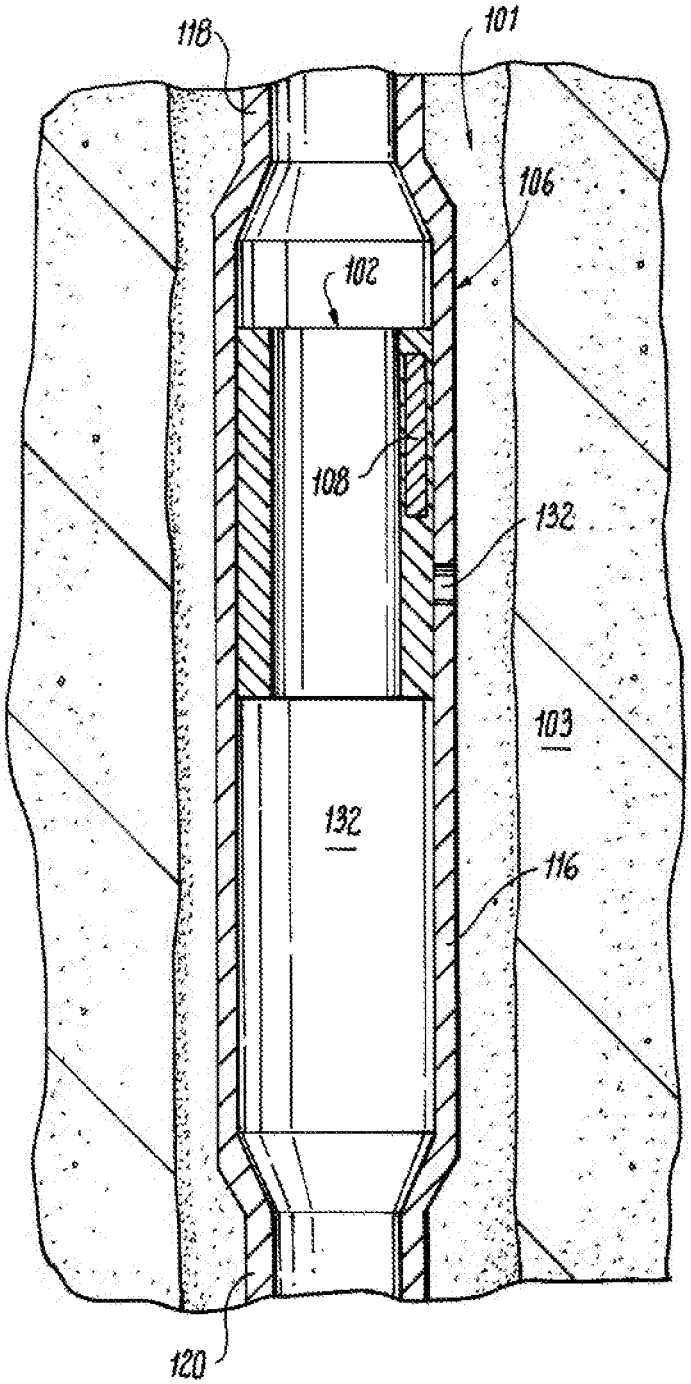
FIG. 15 is a schematic cross-sectional side elevation view of the sensor assembly of FIG. 1, showing the patch seated in the well casing proximate an aperture for fluid communication between a well annulus external to the well casing and an interior space of the well casing.

With reference now to FIG. 15, the patch 102 can be seated in the well casing 106 proximate an aperture 132 through the well casing 106 that places an interior space 134 of the well casing 106 in fluid communication with a well bore annulus 101 exterior of the well casing 106. The sensor 108 can therefore be configured to monitor annulus conditions 101 from within the well casing 106 by contact with fluids flowed into the interior space 134 from the annulus 101.

Figure 16:
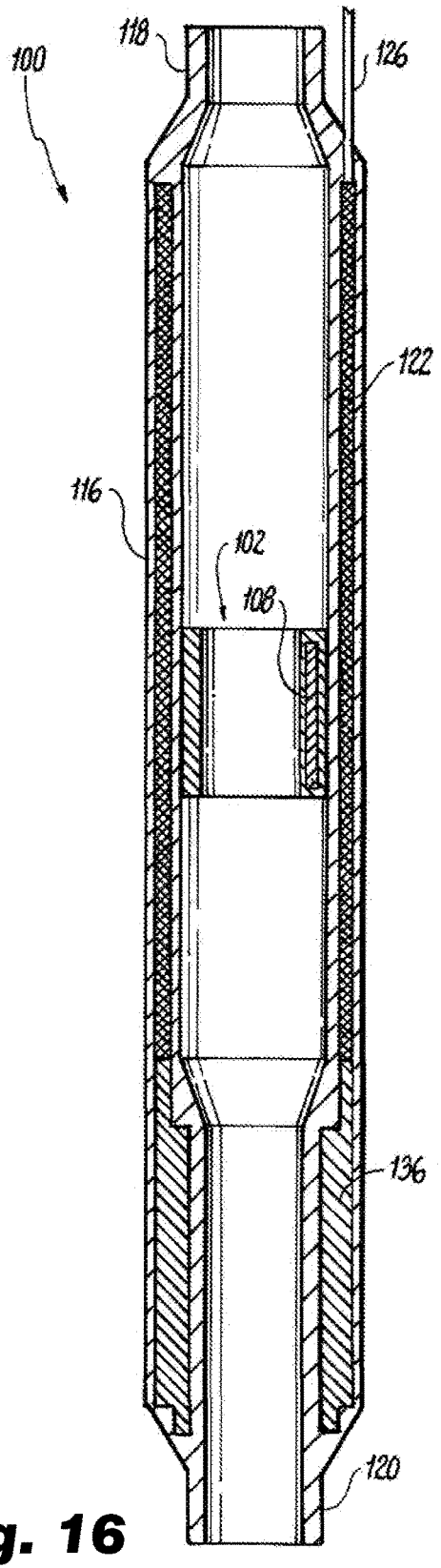
FIG. 16 is a schematic cross-sectional side elevation view of the sensor assembly of FIG. 1, showing a tool in the well casing operatively connected to the sensor for control of the tool.
Figure 17:
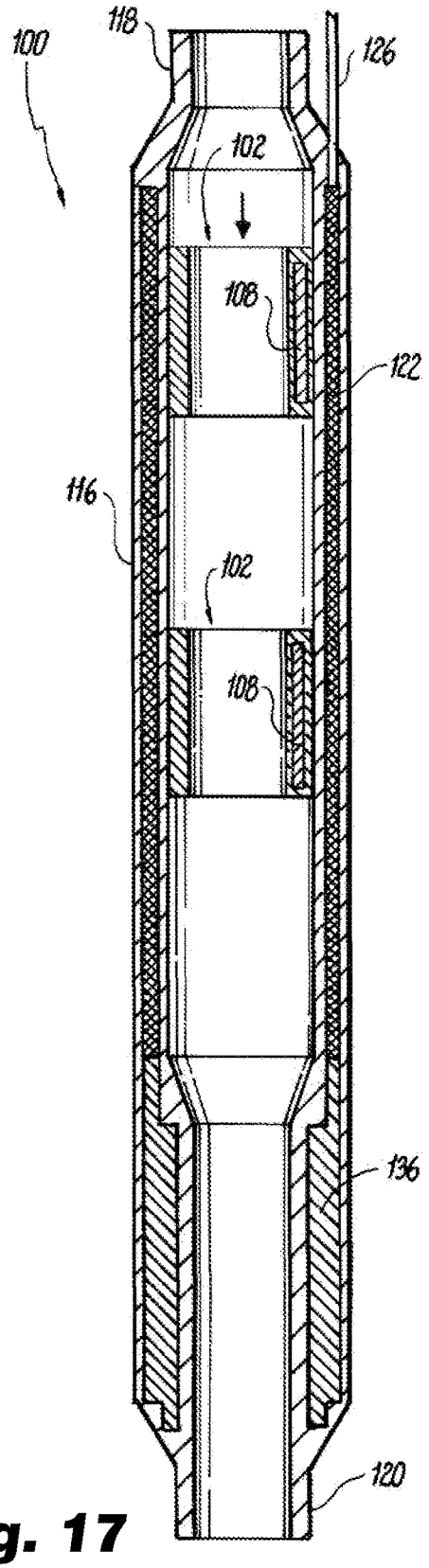
FIG. 17 is a schematic cross-sectional side elevation view of the sensor assembly of FIG. 16, showing the sensor assembly deployed as a replacement and/or upgrade for a previously deployed sensor assembly.

With reference now to FIG. 16, the well casing 106 can include a well tool 136 such as a choke, valve, or an inflow control device (ICD) operatively connected to the sensor 108, wherein the sensor 108 is configured to provide control input to the well tool 136, e.g. based on a value from a transducer of sensor 108. For example, a value from a PH transducer in sensor 108 can be used to control actuation of a valve. As shown in FIG. 17, when the sensor 108 of FIG. 16 fails due to passage of its useful life time, is preempted by an upgraded version, or needs to be replaced for any other suitable reason, a new sensor 108 can be deployed and seated with a new patch 102 (e.g., the lower most patch 102 and sensor 108 in FIG. 17) without necessitating removal of the original sensor 108 (the upper most sensor 108 in FIG. 17). For example, if an upgraded version of the transducer, controller, and/or logic for controlling the tool 136 is available, the new sensor 108 can be deployed into position and the original sensor 108 can be deactivated, e.g., by a signal from line 126 and coil 122 and/or by a signal from the new sensor 108. This facilitates expansion and/or improvement of the functionality of the tool 136 relative to traditional techniques.

Using systems and methods as disclosed herein, it is not necessary to retrieve old or dead sensors to deploy new sensors, and the number of sensors is not limited to a number of sensor receptacles within a well casing, for example.

Accordingly, as set forth above, the embodiments disclosed herein may be implemented in a number of ways. For example, in general, in one aspect, the disclosed embodiments relate to a sensor assembly. The sensor assembly includes a patch with a wall configured to be seated in a wall within a wellbore. A sensor is mounted to the wall of the patch.

In accordance with any of the foregoing embodiments, the wall of the patch can define a central passage therethrough configured to allow passage of downhole tools therethrough. The wall of the patch can be expandable from a first compressed diameter to a second expanded diameter. The wall of the patch can include at least one of a bendable expandable structure, a stretchable structure, and/or an internally trussed expandable structure.

In accordance with any of the foregoing embodiments, the sensor is a passive sensor, optionally, wherein the sensor includes a tracer configured to release a chemical. It is also contemplated that the sensor can be an active sensor, optionally wherein the sensor includes at least one of an electrically powered transducer for pressure, temperature, flow rate, flow composition, vibration, acoustics, and/or permeability.

In accordance with any of the foregoing embodiments, the sensor can be configured to be coupled to electronics and/or wireless telemetry.

In accordance with any of the foregoing embodiments, the sensor can include an internal power source.

In accordance with any of the foregoing embodiments, the sensor assembly can include a well casing wherein the wall of the patch is affixed to an inner surface of the well casing, wherein a drift diameter is defined through the well casing, wherein the wall of the patch and the sensor clear the drift diameter for passage of downhole tools therethrough.

In accordance with any of the foregoing embodiments, the well casing can include an expanded diameter portion with an inner diameter lager than that of the well casing uphole and downhole from the expanded diameter portion, wherein the patch and sensor are seated within the expanded diameter portion.

In accordance with any of the foregoing embodiments, the well casing can include a coil connected to a line for communication and/or power, wherein the sensor is operatively connected to the coil to receive power and/or communicate up well.

In accordance with any of the foregoing embodiments, the well casing can include a combination of at least two of: an expanded diameter portion without a coil, an expanded diameter portion that includes a coil, and/or a smaller diameter portion with an inner diameter smaller than the expanded diameter portion or portions.

In accordance with any of the foregoing embodiments, There can be at least two expanded well portions that each include a respective coil, wherein the coils are connected by a power and/or communication line.

In accordance with any of the foregoing embodiments, there can be multiple patches with respective sensors seated within the well casing.

In accordance with any of the foregoing embodiments, the assembly can include at least one distributed sensor having sensor components operatively connected to each other but physically spaced apart along at least one of a longitudinal axis of the well casing and/or a circumference of the well casing.

In accordance with any of the foregoing embodiments, the patch can be seated in the well casing proximate an aperture through the well casing that places an interior space of the well casing in fluid communication with a well bore annulus exterior of the well casing, wherein the sensor is configured to monitor annulus conditions.

In accordance with any of the foregoing embodiments, the well casing can include a well tool operatively connected to the sensor, wherein the sensor is configured to provide control input to the well tool.

The methods and systems of the present disclosure, as described above and shown in the drawings, provide for deployment of downhole sensors with superior properties including ease of placement, replacement, and upgrade. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A sensor assembly comprising:

a patch with a wall configured to be seated in a wall within a wellbore;

a sensor mounted to a solid portion of the wall of the patch between apertures of the patch, wherein the solid portion of the wall of the patch is expandable to engage well casing within the wellbore; and the well casing comprising a coil communicatively coupled to a line positionable to provide communication and power, wherein the sensor is operatively connected to the coil to receive power from the line and to provide communications to the line.

2. The sensor assembly as recited in claim 1, wherein the wall of the patch defines a central passage therethrough configured to allow passage of downhole tools therethrough, wherein the wall of the patch is expandable from a first compressed diameter to a second expanded diameter, and wherein the wall of the patch comprises:

a bendable expandable structure;

a stretchable structure; or an internally trussed expandable structure.

3. The sensor assembly as recited in claim 1, wherein the sensor is a passive sensor, optionally, wherein the sensor includes a tracer configured to release a chemical.

4. The sensor assembly as recited in claim 1, wherein the sensor is an active sensor comprising an electrically powered transducer for pressure, temperature, flow rate, flow composition, vibration, acoustics, permeability, or a combination threreof.

5. The sensor assembly as recited in claim 1, wherein the sensor is configured to be coupled to electronics and wireless telemetry.

6. The sensor assembly as recited in claim 1, wherein the sensor includes an internal power source.

7. The sensor assembly as recited in claim 1, further comprising:

the well casing wherein the wall of the patch is affixed to an inner surface of the well casing, wherein a drift diameter is defined through the well casing, wherein the wall of the patch and the sensor clear the drift diameter for passage of downhole tools therethrough.

8. The sensor assembly as recited in claim 7, wherein the well casing includes an expanded diameter portion with an inner diameter lager than that of the well casing uphole and downhole from the expanded diameter portion, wherein the patch and sensor are seated within the expanded diameter portion.

9. The sensor assembly as recited in claim 7, wherein the well casing includes a combination of at least two portions selected from the group consisting of:

an expanded diameter portion without the coil;

an expanded diameter portion that includes the coil; or a smaller diameter portion with an inner diameter smaller than the expanded diameter portion or portions.

10. The sensor assembly as recited in claim 9, wherein there are at least two expanded well portions that each include a respective coil, wherein the coils are connected by a power and communication line.

11. The sensor assembly as recited in claim 9, wherein there are multiple patches with respective sensors seated within the well casing.

12. The sensor assembly as recited in claim 11, wherein the sensors include a distributed sensor having sensor components operatively connected to each other but physically spaced apart along a longitudinal axis of the well casing, a circumference of the well casing, or a combination thereof.

13. The sensor assembly as recited in claim 7, wherein the patch is seated in the well casing proximate an aperture through the well casing that places an interior space of the well casing in fluid communication with a well bore annulus exterior of the well casing, wherein the sensor is configured to monitor annulus conditions.

14. The sensor assembly as recited in claim 7, wherein the well casing includes a well tool operatively connected to the sensor, wherein the sensor is configured to provide control input to the well tool.

15. A sensor assembly comprising:

a patch with a wall configured to be seated in a wall within a wellbore; and a sensor mounted to a solid portion of the wall of the patch between apertures of the patch, wherein the solid portion of the wall of the patch is expandable to engage a well casing within the wellbore, and wherein the sensor comprises a turbine generator power source.

* * * * *